United States Patent [19]

Lindberg et al.

[11] Patent Number: 4,504,176

[45] Date of Patent: Mar. 12, 1985

[54] METHOD FOR COMPACTING COMPACTABLE SOILS BY VIBRATION

[75] Inventors: Bertil J. Lindberg, Västra Frölunda; Bernt C. G. Elmefjäll, Upsala, both of Sweden

[73] Assignee: Byggnads-& Industriservice AB Binab, Solna, Sweden

[21] Appl. No.: 384,440

[22] Filed: Jun. 2, 1982

[51] Int. Cl.[3] ..... E02D 3/02; E01C 19/34

[52] U.S. Cl. ..... 405/271; 173/20; 404/133

[58] Field of Search ..... 405/266, 269, 271; 404/133; 172/40; 73/32 A, 84, 594; 173/1, 20, 21, 23, 139

[56] References Cited

U.S. PATENT DOCUMENTS

| | | | |
|---|---|---|---|
| 1,459,102 | 6/1923 | Hughes | 173/20 X |
| 2,782,605 | 2/1957 | Wertz et al. | 405/269 X |
| 3,282,055 | 11/1966 | Landau | 405/271 |
| 3,712,067 | 1/1973 | van Weele | 405/271 |
| 3,865,501 | 2/1975 | Kniep | 405/271 X |
| 4,063,424 | 12/1977 | Takagi | 405/269 X |
| 4,112,692 | 9/1978 | Anderson | 405/271 |
| 4,280,770 | 7/1981 | Woodruff | 404/133 |
| 4,348,901 | 9/1982 | Vural et al. | 404/133 X |

FOREIGN PATENT DOCUMENTS

| | | | |
|---|---|---|---|
| 2246167 | 4/1975 | France | 405/271 |
| 165316 | 12/1980 | Japan | 405/269 |

*Primary Examiner*—Cornelius J. Husar
*Assistant Examiner*—Nancy J. Stodola
*Attorney, Agent, or Firm*—Fleit, Jacobson, Cohn & Price

[57] ABSTRACT

In a method for compacting compactable soils by vibration while using a compacting apparatus comprising an elongate member having a vibrator mounted on one end thereof, and further having laterally projecting fins arranged along at least part of the length thereof, the elongate member is inserted to a given depth into soil to be compacted and there vibrated to densify and compact soil surrounding said elongate member while withdrawing the elongate member from a compacted location when the load required to lift the elongate member together with the vibrator from said location, while the member is vibrating, is at least equal to a previously established set-point value corresponding to a desired degree of compaction.

4 Claims, 7 Drawing Figures

18
19
22
20
20
37
16
21
23
38
24
41
27
39
32
30
40
31
29
34
36
28
42
26
43
15
14
25
44
26
10
17
26
11
12

METHOD FOR COMPACTING COMPACTABLE SOILS BY VIBRATION

The present invention relates to methods for compacting compactable soils by vibration, and to apparatus for carrying out said methods.

In present day methods for compacting compactable soils by vibration, it is difficult to ascertain what degree of compaction has been achieved without making frequent tests. Such tests, however, are time consuming, and require a probe provided with pressure measuring means to be inserted into the compacted soil at frequent intervals.

The vibratory tubes used in present day soil-compacting methods are also extremely heavy, necessitating the provision of large, and subsequently heavy vibrators, requiring a commensurate high input energy and resulting in difficulties in maneuvering and transporting such apparatus.

Moreover, when applying such, known soil-compacting methods it is normal practice to vibrate and compact the soil in stages, at one level at a time, which means that movement of the vibratory tube out of the soil is stopped at several different levels.

An object of the present invention is to provide methods and means whereby one or more of the above drawbacks are overcome.

To this end there is provided in accordance with the invention a method for compacting compactable soils by vibration while using a compacting apparatus comprising an elongate member having a vibrator mounted on one end thereof, and further having laterally projecting fins arranged along at least part of the length thereof, said method comprising inserting the elongate member to a given depth into soil to be compacted and vibrating the elongate member to densify and compact soil surrounding said elongate member, and withdrawing the elongate member from a compacted location when the load required to lift the elongate member from said location while vibrating is at least equal to a previously established setpoint value correspondinq to a desired degree of compaction. In this way it is possible to ascertain the degree of compaction of the soil with good precision, thereby obviating the need to run frequent tests.

According to another aspect of the invention there is provided a method for compacting compactable soils by vibration, comprising inserting substantially vertically into soil to be compacted an elongate member having a vibrator mounted on the top end thereof and having laterally projecting fins spaced axially over a length of said member at least substantially equal to the depth to which said member shall be inserted into the soil, and vibrating the elongate member to densify and compact soil surrounding said elongate member, at least when withdrawing said elongate member from the soil.

This method enables soil to be densified and compacted over a given depth to the desired degree of compaction with the use of vibrating compaction apparatus substantially lighter in weight than apparatus used in known soil compacting methods using vibration, and at much faster rates.

When applying the method according to the invention, the major part of said compaction can be effected as the elongate member is withdrawn while vibrating the elongate member and, in addition, the degree to which the soil is compacted can be controlled by controlling the speed at which the elongate member is withdrawn. Thus, the soil may be compacted during substantially continuous upward movement of the elongate member.

According to one aspect an apparatus for compacting compactable soils by vibration comprises an elongate member; a vibrator mounted on one end of the elongate member for setting up vibrations therein; vibration-propagating means in the form of laterally projecting fins arranged in substantially vertical planes along at least part of the elongate member; means for lifting said elongate element; and means for sensing the load required to lift the elongate member and the vibrator mounted thereon.

According to a further aspect of the invention there is provided an apparatus for compacting compactable soils by vibration, comprising an elongate member; a vibrator mounted on one end of the elongate member for setting up vibrations therein; vibration-propagating means in the form of laterally projecting fins arranged in substantially vertical planes and spaced axially along substantially the whole of the effective length of the elongate member; and means for lifting said elongate member.

So that the invention will be more readily understood and further features thereof made apparent, an exemplary embodiment of the invention will now be described in detail with reference to the accompanying schematic drawings, in which FIG. 1 illustrates an apparatus for compacting soil by vibration in accordance with the invention;

Figure 1:
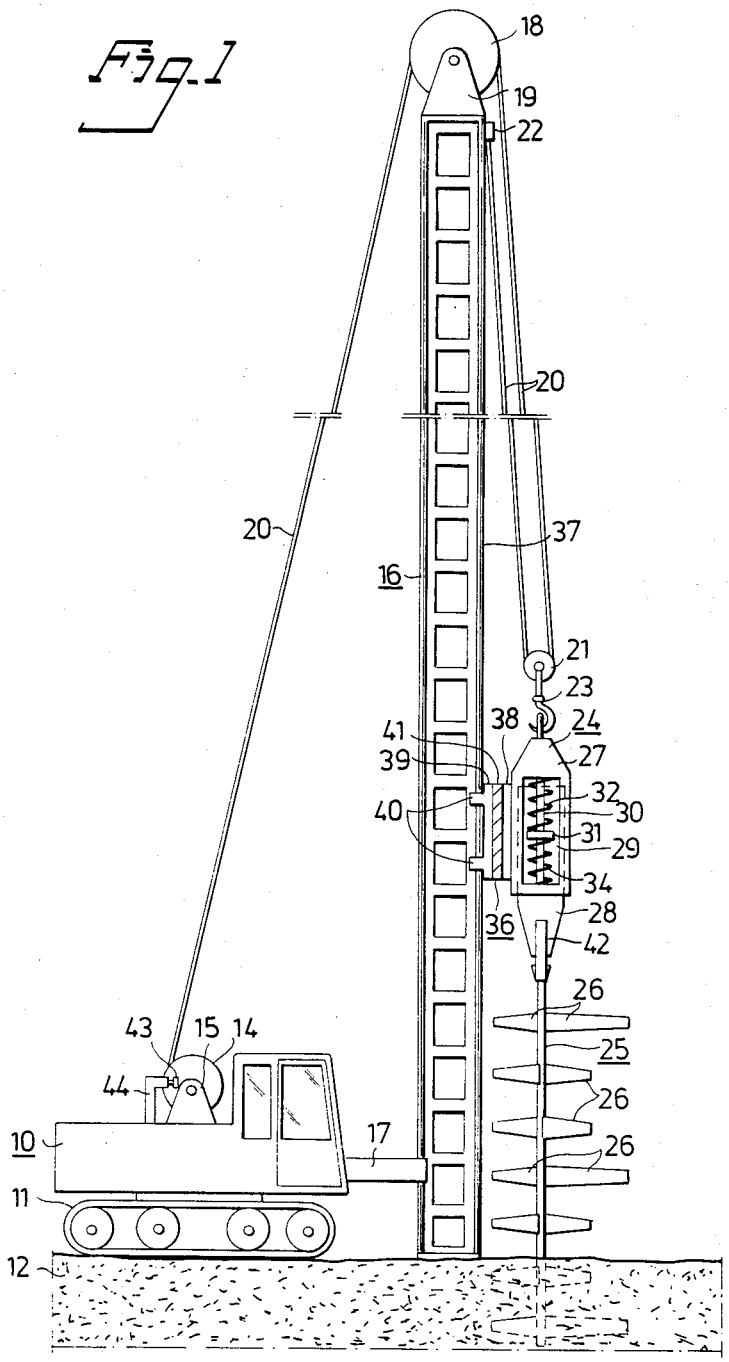

In FIG. 1 there is shown a vehicle 10 supported by track means 11 on ground 12 undergoing compaction. Arranged on the vehicle 10 is a winch mechanism, comprising a winch drum 14 mounted for rotation on a bracket structure 15.

As shown in the Figure, the vehicle 10 is connected to a mast 16 via a member 17. The mast 16 rests on ground 12 and can be lifted free from the ground and-,moved from compacting site to compacting site, in a manner not shown. Arranged at the top of the mast 16 is a pulley 18, which is rotatably mounted in a bracket structure 19. Extending from the winch drum 14 is a line 20, for example a steel-wire rope, which passes over the pulley 18, down to a further pulley 21, and from there rearwardly to a load sensor 22 which is mounted at the top of the mast 16 and which is adapted to sense the load on line 20, for a purpose made apparent hereinafter.

Depending from pulley 21 is a hook means 23 from which is hung a vibrator means 24 having connected thereto an elongate member 25 provided with a plurality of vibration-propagating fins 26 arranged in mutually spaced relationship axially along said member 25.

The vibrator means 24 of the illustrated embodiment comprises a yoke structure 27 which carries the actual vibrator 28, and which has mutually opposite, elongate openings, of which only one, 29, is shown. Arranged vertically in each opening 29 is a bar 30 which passes freely through a transversal lug 31 fixedly connected to the vibrator 28. An upper spring means 32 is arranged around bar 30 between the transversal lug 31 and an upper defining surface of the opening 29, while a lower spring means 34 is arranged around bar 30 between said lug and a lower defining surface of said opening, the spring means 32 and 34 preventing excessive transmission of vibrations generated by the vibrator 28 to the line 20 via the hook means 23 and pulley 21.

Figure 3:
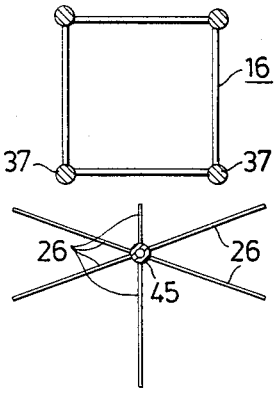
FIG. 3 is a cross-sectional view taken on the line III—III in FIG. 2, the Figure also showing a section through a mast for guiding the elongate member.

In the illustrated embodiment the yoke 27 is guided for movement along the mast 16 by means of a guide 36, which is slidably mounted on tracks 37 on the mast 16, these tracks also being shown in FIG. 3. The guide 36 of the illustrated embodiment comprises a first plate-like element 38 fixedly attached to the yoke 27 on a side thereof adjacent the mast 16, a second plate-like element 39 provided with runners or like guide means 40 for engaging tracks 37 to permit guided movement of the guide 36 therealong, and cushioning means 41 arranged between said first and said second plate-like elements for cushioning or deadening vibrations which would otherwise be transmitted to the mast 16 via said guide 36.

To ensure substantially maximum transmission of the vibrations from the vibrator 28 to the elongate member 25, the vibrator is preferably connected to said member by metallic connecting jaw-means, as indicated at 42.

For the purpose of measuring the extent to which line 20 is payed out and taken up on the drum 14 during a soil-compacting operation, the winch mechanism 14, 15 is arranged to co-act with a line-measuring means, which in the illustrated embodiment comprises a roller 43 which is carried on a rigid arm 44 and which cooperates with the drum 14 in a manner such as to measure the length of line 20 payed out by or taken up on said drum. It will be understood that the line-measuring means 43, 44 is not limited to the described roller and arm arrangement but may comprise any suitable means for measuring line lengths.

Figure 2:
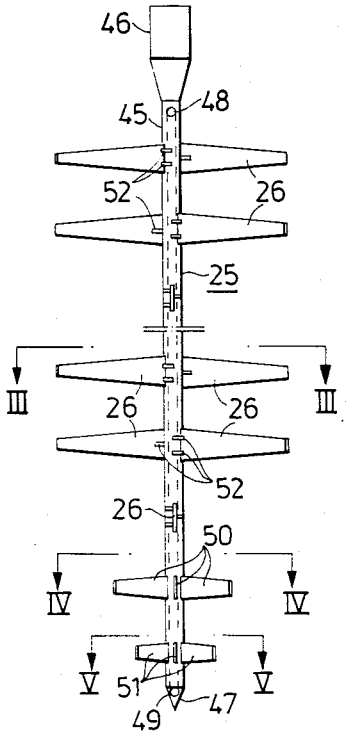
FIG. 2 is a broken view of an elongate member illustrated in FIG. 1.

As will be seen more clearly in FIG. 2, the elongate member 25 comprises a tube 45 having a head means 46 at the top end thereof and a pointed part 47 at the bottom thereof. Arranged in the tube 45 adjacent the head means 46 is an inlet opening or port 48, while at least one outlet opening or port 49 is arranged in the pointed part 47, said inlet and outlet ports 48, 49 being interconnected by a passage formed by the interior of tube 45. The ports 48, 49 and said passage are intended to permit a fluid, such as a gas or water, or a liquid slurry of cement to be fed through the elongate member 25 to the vicinity of the soil being compacted, in order to facilitate compaction or to further stabilize the soil.

As shown, the vibration-propagating fins 26 are spaced axially along the tubular member 45 and extend in substantially vertical planes. The total spacing between the laterally projecting fins 26 is at most equal to half the effective length of the tubular member 45, i.e. the length thereof effective in a vibratory compaction operation. Each of the fins 26 has a root-height to fin-length ratio of from 1:1 to 7:1, preferably from 1.5:1 to 5:1.

In accordance with the invention the fins 26 are arranged in sets of at least two fins, the fins of one set being located in a vertical plane which forms angles with vertical planes in which the fins 26 of adjacent sets are located. When said sets of fins each comprise two fins 26, the fins are placed in diametrically opposed relationship with one another, and the pairs of fins 26 are arranged in groups of three with the fins 26 of three adjacent fin-pairs of each group being located in vertical planes rotated relative to one another as more clearly shown in FIG. 3. Thus, the fins 26 of each fourth pairs of fins will lie in mutually the same vertical planes. This ensures effective compaction of the soil.

Figure 4:
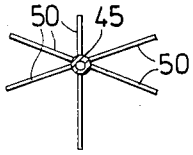
FIG. 4 is a cross-sectional view taken on the line IV—IV in FIG. 2.
Figure 5:
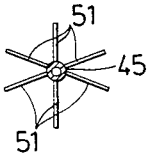
FIG. 5 is a cross-sectional view taken on the line V—V in FIG. 2.

To enable the elongate member 25 to move vertically, relatively close to the mast 16 and substantially parallel therewith, fins 26 extending towards the mast 16 are shorter than the remaining fins 26, as shown in FIG. 3 and 4.

The defining surfaces of the fins 26 are inclined to the horizontal, and the fins taper from root to tip, the taper corresponding to a root-height to tip-height ratio of from 1.5:1 to 8:1.

To facilitate penetration of the elongate member 25 into the soil to be compacted, the member is provided in the bottom region thereof with sets of pilot fins 50, 51, two such sets being shown in the illustrated embodiment.

The pilot fins 50, 51 are shorter than the fins 26 and the number of pilot fins in each set corresponds to the total number of vibration-propagating fins 26 in a group of fins. Thus, each set of pilot fins of the illustrated embodiment comprises six fins, with the pilot fins arranged in all vertical planes containing vibration-propagating fins 26. The planes are selected such as to eliminate any tendency of the elongate member 25 to tilt when being inserted into the soil to be compacted.

Figure 6:
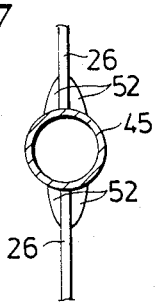
FIG. 6 is a fragmentary sectional view of the elongate member, illustrating plate-like web portions.

As shown in FIG. 6, there is arranged in the transition region of the tubular member 45 and a respective vibration-propagating fin 26 a plate-like web portion 52, which serves to amplify the vibrations set-up in said fin 26.

When compacting soil by means of the illustrated and described apparatus, the vehicle 10 is driven to a compacting location and the elongate member 25 inserted, while vibrating, to a given depth into the soil, the depth to which the elongate member 25 is inserted being commensurate to the length of line 20 paid out from the drum by winch means 14, 15 and being measured by the line-measuring means 43, 44. The elongate member 25 is then lifted, while vibrating, at a lifting rate corresponding to a desired degree of compaction, the load required to lift the elongate member 25, together with the vibrator means 24, being measured by sensor 22, and the length of line 20 taken up being measured by said line-measuring means 43, 44.

The load required to lift the elongate member 25 and the vibrator means 24 from a compacted location is commensurate with the extent to which the soil has been compacted and to the level at which the elongate member 25 is located in the soil.

In order to ensure that the soil is compacted to a desired degree of compaction, the elongate member 25 is withdrawn from the soil at a rate at which the load acting on the line 20 is at least equal to a pre-established set-point value which corresponds to said desired degree of compaction, and which varies with the depth at which the elongate member 25 is located in the soil at any given time during withdrawal, while vibrating. This set-point value can be established while using the illustrated and described elongate member 25, by compacting soil in a pattern of selected test locations while recording the load required to lift the elongate member 25 and vibrator means 24. A probe having pressure measuring means is then inserted into the compacted location, to measure the degree of compaction. When the soil is found to be compacted,to the degree desired, the recorded load required to lift said elongate member and said vibrator means through successive levels at respective locations is taken as the setpoint value for further compacting operations at remaining locations on the same site, it being ensured in this way that the soil in all remaining locations is compacted to the desired degree without further checks being required at at frequent intervals.

Figure 7:
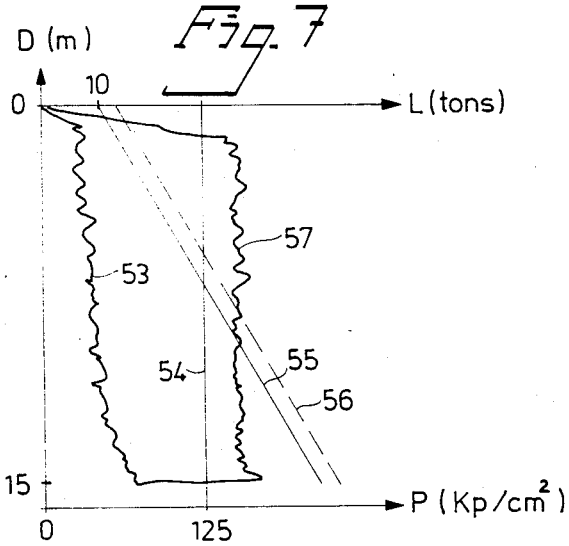
FIG. 7 is a diagram illustrating a preferred method of carrying out the invention.

The above described method of carrying out the invention is illustrated diagrammatically in FIG. 7, in which said load L (measured in tons) and the soil pressure P (measured in kiloponds per sq. centimeters) are plotted against the depth D of soil penetration (measured in meters).

The jagged line 53 illustrates the result of soil pressure tests prior to compaction of the soil, while the vertical line 54 illustrates the desired degree of compaction. The sloping full line 55 (10 tons being the weight of the elongate member 25 and vibrator means 24) illustrates the established set-point load necessary to obtain the desired degree of compaction, while the sloping broken line 56 illustrates the load selected by the operator, this selcted load being slightly higher than the established set-point load, so as to be on the safe side. The actual degree of compaction when following line 56 is shown by the jagged line 57.

As will be seen from the diagram, the top surface layer of the soil 12 must be further compacted, e.g. by means of a soil-compacting roller.

As will be readily understood, means can be provided for processing signals received from the sensor 22 and the line-measuring means 43, 44 and for drawing a line 56 on paper located in a writer herefor, corresponding to the loads sensed by sensor 22 and the lengths of line measured by the line-measuring means 43, 44 when withdrawing the elongate member 25, while vibrating, from a compacted location. This recorded line 56 can be used by the operator firstly as a means for ascertaining that compaction is progressing as desired, and secondly as proof that the work has been carried outin accordance with a prescribed manner.

The above means may be connected to a data processor arranged to effect a prescribed compacting operation automatically. The processing means suitable herefor have not been shown, since they are well known in the art of data-controlled automatic processes and can be designed for the purpose intended by any one of normal skill in the art.

The invention is not restricted to the described and illustrated embodiment, but can be carried into effect in any desired manner lying within the scope of the claims.

We claim:

1. A method for compacting compactable soils by vibration while using a compacting apparatus comprising an elongate member having a vibrator mounted on one end thereof, and further having laterally projecting fins arranged in use in substantially vertical planes along at least part of the elongate member, said method comprising:

a. establishing a set-point value corresponding to a desired degree of compaction of said compactable soils and representing a load required to lift the elongate member from a compacted location while vibrating;

b. inserting the elongate member substantially vertically to a given depth into soil to be compacted and vibrating the elongate member to densify and compact soil surrounding said elongate member; and c. withdrawing the elongate member from a compacted location when the load required to lift the elongate member from said location while vibrating is at least equal to said established set-point value.

2. A method according to claim 1, wherein the laterally projecting fins are spaced axially along the elongate member over a length thereof at least substantially equal to the depth to which said member shall be inserted into said soil.

3. A method according to claim 2, wherein a major part of the compaction is effected as the elongate member is withdrawn while vibrating.

4. A method for compacting compactable soil by vibration while using a compacting apparatus, the method comprising:

a. establishing a set-point value for at least one soil location corresponding to a desired degree of compaction of said compactable soils and representing a load required to lift at a given rate the compacting apparatus from a given depth within a compacted location while vibrating;

b. inserting the compacting apparatus to said given depth into soil to be compacted in another soil location and vibrating the apparatus to densify and compact soil surrounding the apparatus; and c. withdrawing the apparatus from the compacted location when the load required to lift the apparatus from said location while vibrating is at least equal to said established set-point thereby ensuring that the desired degree of compaction has been met or exceeded.

* * * * *